US009163486B2

(12) United States Patent
Lugo

(10) Patent No.: US 9,163,486 B2
(45) Date of Patent: Oct. 20, 2015

(54) SUBSEA STRUCTURE FLOWLINE CONNECTOR ASSEMBLY

(71) Applicant: TRITON CONNECTOR SOLUTIONS PTE. LTD, Singapore (SG)

(72) Inventor: Mario Rene Lugo, The Woodlands, TX (US)

(73) Assignee: TRITON CONNECTOR SOLUTIONS PTE. LTD., Singapore (SG)

( * ) Notice: Subject to any disclaimer, the term of this patent is extended or adjusted under 35 U.S.C. 154(b) by 0 days.

(21) Appl. No.: 14/355,167

(22) PCT Filed: Dec. 11, 2012

(86) PCT No.: PCT/SG2012/000466

§ 371 (c)(1),
(2) Date: Apr. 29, 2014

(87) PCT Pub. No.: WO2013/089643

PCT Pub. Date: Jun. 20, 2013

(65) Prior Publication Data

US 2014/0305654 A1 Oct. 16, 2014

Related U.S. Application Data

(63) Continuation-in-part of application No. 13/316,907, filed on Dec. 12, 2011, now abandoned.

(51) Int. Cl.
*E21B 43/013* (2006.01)

(52) U.S. Cl.
CPC ..... *E21B 43/013* (2013.01)

(58) Field of Classification Search
CPC ..... E21B 43/013; E21B 43/0107
USPC ..... 166/338, 339, 340, 341, 344, 351, 360, 166/365, 378
See application file for complete search history.

(56) References Cited

U.S. PATENT DOCUMENTS 4,075,862 A 2/1978 Ames
4,661,016 A 4/1987 Baugh et al.

(Continued)

FOREIGN PATENT DOCUMENTS

GB 2 176 559 A 12/1986

OTHER PUBLICATIONS

International Search Report, mailed Feb. 8, 2013, for PCT/SG2012/000466, 4 pages.

(Continued)

*Primary Examiner* — James G Sayre
(74) *Attorney, Agent, or Firm* — Seed IP Law Group PLLC

(57) ABSTRACT

A subsea structure flowline connector assembly for a subsea structure having a flowline connector assembly adapted to be mountable to the subsea structure, the flowline connector assembly having a junction plate having a flowline connector therein; an receiver affixed to or adjacent to said junction plate, said receiver having an interior exposed to said flowline connector of said junction plate; a fly-in connector assembly adapted to be connectable to the flowline connector, said fly-in connector assembly having a connector thereon, said connector of said fly-in connector assembly adapted to engage said flowline connector of said junction plate to establish fluid communication, said fly-in connector assembly having a conduit in communication with said connector of said fly-in connector assembly, said conduit adapted to connect to a flowline; an actuating device coupled to the connector for actuating the connector to engage the flowline connector, a brace extending from the actuating device to the conduit for bracing the conduit to the actuating device.

21 Claims, 9 Drawing Sheets

(56) References Cited

U.S. PATENT DOCUMENTS

| | | | | |
|---|---|---|---|---|
| 4,728,125 | A | 3/1988 | Reneau | |
| 4,842,075 | A * | 6/1989 | Kalvenes et al. | 166/341 |
| 5,593,249 | A | 1/1997 | Cox et al. | |
| 5,807,027 | A | 9/1998 | Östergaard | |
| 6,098,715 | A | 8/2000 | Seixas et al. | |
| 6,805,382 | B2 | 10/2004 | Jennings | |
| 6,902,199 | B2 | 6/2005 | Colyer et al. | |
| 7,112,009 | B2 | 9/2006 | Mackinnon | |
| 8,499,839 | B2 * | 8/2013 | Reid et al. | 166/341 |
| 2001/0034153 | A1 * | 10/2001 | McIntosh et al. | 439/364 |
| 2006/0180313 | A1 * | 8/2006 | Reynolds | 166/341 |
| 2007/0009328 | A1 * | 1/2007 | Bastesen et al. | 405/169 |
| 2008/0143100 | A1 * | 6/2008 | Webster | 285/18 |
| 2009/0038805 | A1 * | 2/2009 | Parks et al. | 166/341 |
| 2009/0283274 | A1 | 11/2009 | Lugo | |
| 2011/0005764 | A1 * | 1/2011 | Bekkevold | 166/344 |
| 2012/0168168 | A1 * | 7/2012 | Cruden | 166/338 |

OTHER PUBLICATIONS

Written Opinion, mailed Feb. 8, 2013, for PCT/SG2012/000466, 4 pages.

* cited by examiner

SUBSEA STRUCTURE FLOWLINE CONNECTOR ASSEMBLY

BACKGROUND OF THE INVENTION

1. Field of the Invention

The present invention relates to subsea structure flowline connection systems. More particularly, the present invention relates to systems whereby a fly-in connector is joined to subsea structures so as to establish a flow communication therewith. More particularly, the present invention relates to a flowline connector assembly for use with large bore connections, e.g. 2 inch and above bore connection, between the fly-in connector and the flowline connector.

2. Background

Flowlines are used to interconnect pieces of subsea oilfield equipment for fluid communication, i.e. hydrocarbons (oil/gas), injection fluids/gases or hydraulic fluid. They generally take the form of somewhat flexible armoured hoses or pipes, provided with subsea matable connectors at either end. Typically, they are installed by being lowered into place from a pipe-laying vessel, with the final positioning and make-up of the end connectors carried out by divers or by an ROV. Short ROV-installable hoses and pipes are used to interconnect adjacent pieces of subsea equipment.

Examples of subsea equipment that may be interconnected using flowlines include subsea Christmas trees, manifolds, pipeline end terminations (PLET), capping stacks, blowout preventors or any other subsea structures that require flowline or hydraulic connections. This equipment is typically located on the seabed.

When there are several different pieces of equipment to be interconnected, installation of the necessary pipes and flowlines can be time-consuming and difficult. An end of each flowline is generally lowered vertically to the seabed from a pipe-laying or installation vessel. The flowline is then laid out horizontally between the points to be interconnected. The flowline ends must then be retrieved from the seabed bed by an ROV. The end connectors are aligned with the subsea equipment for make-up of the required fluid-tight, i.e. liquid and/or gas tight, connections.

A known type of connector for the flowline has a first part mounted to a piece of subsea equipment as described earlier, such as a wellhead, and a mating second part fitted to the end of a flowline. In use, the second part is lowered towards the sea bed and is stabbed from above into the first. A pivot arrangement then guides the second part and attached flowline so as to hinge over into a generally horizontal position, in which the flowline may be laid away along the sea bed, and in which the connector first and second mating parts are axially aligned for make-up of a fluid-tight connection between them.

In order to connect various flowlines to the equipment on the ocean floor, special connectors known as "flying leads" are often employed. The flying leads connect the ends of flowlines to subsea equipment, such as connecting to a control pod on a manifold or subsea tree at one end to an umbilical termination assembly at the other end. In shallow water, flying leads are connected to subsea equipment by divers. In deeper waters, one or more remotely-operated vehicles (ROV) are utilized.

Different configurations of flying leads are presently available. Two types of flying leads for interconnecting the elements of a subsea production system are hydraulic flying leads or steel flying leads. Both types of leads may house lines for monitoring, control and, when necessary, chemical injection in the subsea system. Each type of lead has benefits and limitations.

The hydraulic flying leads commonly are made up of thermoplastic hoses of various sizes and configurations. In known arrangement, a nylon "type 11" internal pressure sheath is utilized as the inner layer. A reinforcement layer is provided around the internal pressure sheath. A polyurethane outer sheath is bonded thereto so as to provide waterproofing. End fittings are provided on each end of the thermoplastic hoses. The end fittings are typically crimped or swaged onto the hose. Connected to the end fittings on each of the ends of the hoses is a multiple quick-connect junction plate. This plate provides the connection plate between the subsea equipment and communication lines. It is usually installed using ROV unit subsea.

Steel flying leads presently being used define a collection of separate steel tubes bundled within a flexible vented plastic tube. Typically, a "Cobra" type end connection containing multiple quick-connect junction plate connections is provided at each end of the tubes. The individual tubes are routed into the respective end connections and welded into socket fitting in the opposing junction plate connections. These plates are usually installed by means of ROV units subsea.

One of the problems with the existing systems is that, while they are effective for small bores of less than two inches, they are extremely difficult to install with respect to large bore applications (bores of two inches or greater than two inches). For large bores, flexible or rigid pipe is used to transport or channel the fluid. In large bore applications, the large pressures involved tend to create greater separation pressures, i.e. pressures that separate the flowline from the equipment. As such, they would generally be ineffective in supporting the connection under the effect of great pressures. As such, a need has developed so as to provide a subsea flowline connection assembly which can be used for large bore applications and which can withstand the great pressures involved in such applications.

In the past, various patents have issued relating to subsea flowline connection assemblies. For example, U.S. Pat. No. 4,661,016, issued on Apr. 28, 1987 to Baugh et al., describes a subsea flowline connector for remotely connecting and releasing a first flowline to a complementary second flowline at a submerged location without the use of divers. Seals in the connector may be remotely replaced without the need to bring the connector to the surface. A bundle of control/supply lines are remotely connected to respective submerged lines at the same time as the flowline is connected.

U.S. Pat. No. 4,728,125, issued on Mar. 1, 1988 to B. J. Reneau, describes a grip-and-seal mechanically-locking flowline connector. In particular, flowlines have separately actuated gripping and sealing assemblies which are actuated by hydraulic pressure but are held in actuated positions using internally mounted mechanical-type mechanisms.

U.S. Pat. No. 5,593,249, issued on Jan. 14, 1997 to Cox et al., provides a diverless flowline connection system for connecting a flowline to a subsea wellhead or other subsea structure. The diverless flowline connection system is used with an ROV. The diverless flowline connection system includes a frame assembly having clamping arms for mounting the frame assembly to the flowline. A pair of winches are mounted to the frame assembly. Each winch includes a winch line for attachment to the wellhead to which the flowline is to be connected. Each winch is independently controlled so that the lateral position of the flowline may be variously adjusted by controlling each of the winches.

U.S. Pat. No. 5,807,027, issued on Sep. 15, 1998 to I. Ostergaard, shows a system for pull-in and interconnection of two pipelines in subsea position. A first pipeline is initially freely suspended. A second pipeline is mounted on a bottom-based manifold frame. The end section of the first pipeline is provided with a socket-like termination with a front end, which is provided with means for coupling of the terminator to complementary pipe coupling means on the second pipeline. The terminator is provided with a laterally-directed, longitudinally-shaped anchor member. The manifold frame is provided with receiving means for receipt and fixation of the anchor element. The anchor element and the receiving means are dimensioned and positioned such that when the anchor element is placed in position in the receiving means, the coupling means of the terminator will be positioned straight in front of the complementary coupling means on the second pipeline.

U.S. Pat. No. 6,805,382, issued on Oct. 19, 2004 to C. E. Jennings, describes a one-stroke soft-land flowline connector. A frame is used to land on a base and soft land a connector receptacle on the end of a flowline to a mandrel protruding from the base. After the frame lands on the base, the frame and the receptacle are pushed toward the base so as to cause frame latching members to latch the frame to the base. The frame holds the base and the receptacle above the mandrel. The frame and receptacle are pushed further towards the base and the connector receptacle abuts the mandrel. The connector receptacle moves relative to the frame as the frame is pushed closer to the base. This causes an actuator on the frame to move dogs on the receptacle to engage the mandrel and lock the receptacle to the mandrel.

U.S. Pat. No. 6,098,715, issued on Aug. 8, 2000 to Seixas et al., provides a flowline connection system having a pivotally-mounted funnel which is a permanent part of a subsea structure. The funnel is rotatably mounted so as to rotate from a vertical position to a horizontal position. Retractable pins engage a slot in the funnel to lock the funnel in a vertical position. This allows the funnel to rotate to the horizontal position to engage a hub connector. A flowline end termination stabs into the funnel while the funnel is in the vertical position. The flowline termination body has a flange connector on one end that connects to a flexible flowline.

U.S. Pat. No. 6,902,199, issued on Jun. 7, 2005 to Colyer et al., provides an ROV-activated subsea connector so as to connect a subsea flowline to a subsea connector hub. The connector has a frame with a tubular mandrel located within it. The mandrel connects to the flowline and has a forward end that engages the connector end. The mandrel moves axially relative to the frame between retracted and extended positions. A lock member on the forward end of the mandrel will engage the profile of the connector hub. An actuator mounted to the mandrel causes the lock member to move into engagement with the connector hub after the mandrel has been moved into engagement with the connector hub.

U.S. Pat. No. 7,112,009, issued on Sep. 26, 2006 to C. Mackinnon, provides an apparatus for substantially horizontal connection of a conduit to a subsea structure. A frame connectable to and supportable by the subsea structure. The frame has a docking device operable to allow a horizontal connection device to dock with the frame such that the frame is capable of bearing at least part of an operational load associated with the horizontal connection of the conduit to the subsea structure.

U.S. Patent Publication No. 2009/0283274, published on Nov. 19, 2009 to M. R. Lugo, discloses a connector assembly for connecting a hot stab to a hydraulic hose. The hot stab has a fluid conduit connector thereon. A hydraulic hose has a connector assembly at an end thereof suitable for joining to the fluid conduit connector of the hot stab. A sleeve is affixed to the hot stab and to the hydraulic hose so as to extend over and surround the fluid conduit connector and the connector assembly. A jam nut is affixed to the tubular portion of the fluid conduit connector. The sleeve is threadedly connected to the threaded exterior surface of the jam nut.

It is an object of the present invention to provide a subsea flowline connection system which is particularly configured to withstand the high pressures associated with large bore applications.

It is another object of the present invention to provide a subsea flowline connection system which facilitates the ability of an ROV to connect a fly-in connector to a flowline connector of the subsea structure.

It is still another object of the present invention to provide a subsea flowline connection system which allows the large bending moments from the flowline to be distributed over to the fixed part on the subsea structure.

It is still another object of the present invention to provide a subsea flowline connection system which effects a secure and strong seal between the fly-in connector and the flowline connector.

It is still another object of the present invention to provide a subsea flowline connection system which allows for flowline misalignment during the installation process.

These and other objects and advantages of the present invention will become apparent from a reading of the attached specification and appended claims.

BRIEF SUMMARY OF THE INVENTION

The present invention relates to a subsea structure flowline connector assembly for a subsea structure having a flowline connector assembly adapted to be mountable to the subsea structure, the flowline connector assembly having a junction plate having a flowline connector therein, an receiver affixed to or adjacent to said junction plate, said receiver having an interior exposed to said flowline connector of said junction plate; a fly-in connector assembly adapted to be connectable to the flowline connector, said fly-in connector assembly having a connector thereon, said connector of said fly-in connector assembly adapted to engage said flowline connector of said junction plate to establish fluid communication, said fly-in connector assembly having a conduit in communication with said connector of said fly-in connector assembly, said conduit adapted to connect to a flowline; an actuating device coupled to the connector for actuating the connector to engage the flowline connector, a brace extending from the actuating device to the conduit for bracing the conduit to the actuating device.

Said flowline connector may be a male fixed connector, said connector of said fly-in connector assembly may be a female-free connector, wherein the connector of the fly-in connector assembly, when connected to flowline connector, encircles the flowline connector to form a liquid/gas tight sealing relationship to establish fluid communication.

Said connector may have a metal seal disposed at about an end thereof and a first elastomeric seal disposed within an inner borehole surface of the connector, said first elastomeric seal spaced from the metal seal, and a first hole extends through a wall of said connector and disposed between the metal seal and the first elastomeric seal, wherein when the connector may be connected to the flowline connector, a sealing interface may be formed by the metal seal and the first elastomeric seal between the connector and the flowline connector for providing a fluid tight connection between the connector and flowline connector.

Said assembly may further include a second elastomeric seal disposed within the inner borehole surface of the connector in spaced relationship to said first elastomeric seal and away from the metal seal, and a second hole extending through the wall of said connector, said second hole disposed between said first elastomeric seal and said second elastomeric seal.

Said connector may include a first elastomeric seal disposed within an inner borehole surface of the connector, a second elastomeric seal disposed within the inner borehole surface of the connector in spaced relationship to said first elastomeric seal and a hole extending through the wall of said connector, said hole disposed between said first elastomeric seal and said second elastomeric seal, wherein when the connector may be connected to the flowline connector, a sealing interface may be formed by the first elastomeric seal and the second elastomeric seal between the connector and the flowline connector for providing a fluid tight connection between the connector and flowline connector.

Said fly-in connector assembly may further include a key extending radially outwardly from the connector, said key having at least one channel in fluid communication with one or more holes, wherein one end of each channel forms an orifice on the key and the other end connected to the one or more holes.

Said actuating device may include a first portion having a threaded cylindrical outer surface and a second portion having a threaded cylindrical inner surface and said second portion movable with respect to the first portion, both in threaded relation, wherein the brace extends from the second portion to the conduit.

Said actuating device may include an end effector coupled to said first portion of said actuating device, said end effector suitable for allowing an ROV to rotate said end effector and in turn rotates said said portion of the actuating device so as to move the second portion and said connector of said fly-in connector assembly toward said flowline connector.

Said receiver may include a first plate and a second plate in spaced relation to said first plate, each of said first and second plates having an end abutting or adjacent to said junction plate.

Each of said first and second plates being directly affixed to said junction plate which in turn is directly affixed to said subsea structure.

Each of said first and second plates may include a slot formed adjacent an end opposite the end abutting or adjacent the junction plate, said slot comprises a bearing surface thereon substantially parallel to the junction plate and a bottom surface substantially perpendicular to the bearing surface.

Said fly-in connector assembly may include a housing adapted to receive the actuating device, a first insert member and second insert member formed on opposite sides of the housing, each of said first and second insert members having a wing shaped tapering profile such that each of said first and second insert members has a wider end joined to said housing and a narrower end opposite the wider end and away from said housing, said first insert member being receivable in said slot of said first plate and said second insert member being receivable in said slot of said second plate, wherein, each of said first and second inserts, each insert may have a flat surface at an end thereof for bearing against the bearing surface of the respective slots and a bottom surface for abutting said bottom surface of the respective slots.

Said the width of said slots may be greater than the width of the insert member.

Said junction plate may have a guiding slot formed therein adjacent said flowline connector for guiding the fly-in connector assembly.

Said fly-in connector assembly may have a lifting tab having at least one pad eye for receiving external lifting assistance for lifting the fly-in connector assembly, said lifting tab extending radially and outwardly from the housing.

Said conduit may extend outwardly from said connector.

Said assembly may further include a bracing receiving slot arranged on said housing between the first insert member and second insert member wherein said brace extends through the slot and the slot is wider than the brace thus allowing the brace to be rotatable about a longitudinal axis of the actuating device within the bracing receiving slot.

Said assembly may further comprise a torque bucket attached to the housing and a platform mounted on the torque housing for receiving ROV attachments.

Said the ROV attachments may include a grab handle and/or a ROV panel.

The present invention further provides an apparatus having a subsea structure having a flowline therein; and subsea structure flowline connector assembly as provided above.

The present invention further provides a method of connecting a fly-in connector assembly to a flowline connector assembly of a subsea structure flowline connector assembly as provided above, the method having for a subsea structure having aligning the fly-in connector assembly to the alignment receiver structure of the flowline connector assembly; receiving the fly-in connector assembly within the alignment receiver structure; extending the connector of the fly-in connector assembly towards the junction plate of the flow line assembly; connecting the connector of the fly-in connector to the flowline connector of the flowline assembly.

Said fly-in connector assembly is received into the alignment receiver structure in a direction parallel to the junction plate.

Said connector is extended towards the junction plate in a direction substantially perpendicular to the junction plate.

This foregoing section intends to be a summary of the preferred embodiment of the present invention. As such, the language used in this section is not intended to limiting of the various embodiments and configurations that are possible within scope of the present invention. The present invention should be defined by the claims herein and not by the foregoing section.

DETAILED DESCRIPTION OF THE INVENTION

Figure 1:
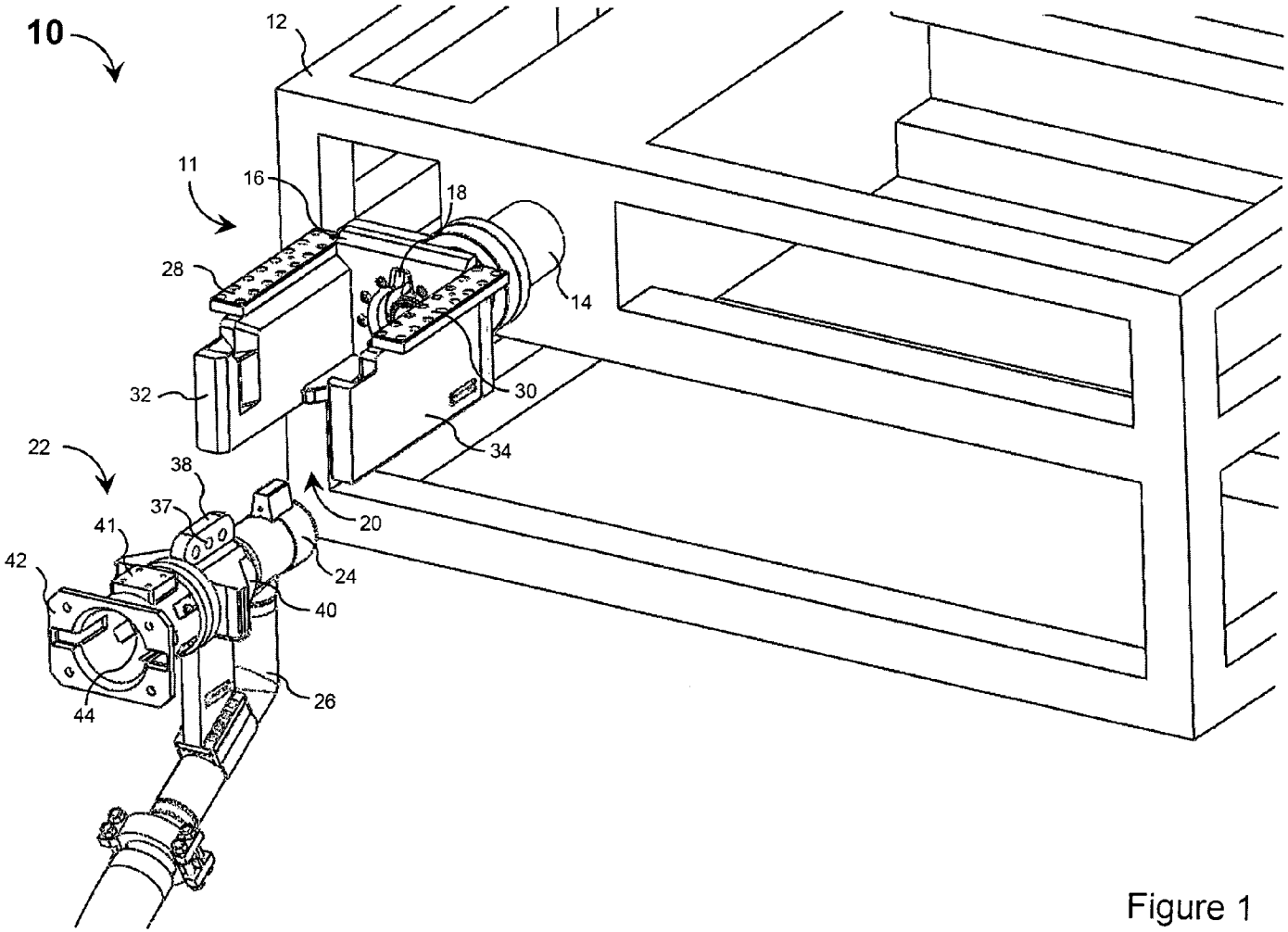
FIG. 1 is a perspective view showing an exemplary embodiment of the subsea flowline connection assembly of the present invention with the fly-in connector assembly in spaced relationship to the junction plate and receiver of the subsea structure.

Referring to FIG. 1, there is shown an exemplary embodiment of the subsea flowline connection assembly 10 of the present invention. The subsea flowline connection assembly 10 consists of a flowline connector assembly 11 and a fly-in connector assembly 22. The flowline connector 18 may be a fixed flowline connector to the subsea structure. The flowline connector assembly 11 may be attached to a subsea structure 12 having a flowline 14 therein. The flowline connector assembly 11 consists of a receiver 20, a junction plate 16 and flowline connector 18 supported by said junction plate 16. A receiver 20 is affixed to or adjacent to the junction plate 16. The receiver 20 has an interior exposed to the flowline connector 18 of the junction plate 16. The subsea flowline connection assembly 10 has a fly-in connector assembly 22 which has a connector 24 thereon. The connector 24 may be engaged with the flowline connector 18 of the junction plate 16. The fly-in connector assembly 22 may be a free fly-in connector which is free to move with respect to the subsea structure. The fly-in connector assembly 22 also has conduit 26 with a flow passageway in communication with the connector 24.

In FIG. 1, it can be seen that the subsea structure 12 is in the nature of a capping stack or a flow diverter. However, within the concept of the present invention, such a "subsea structure" can take on a wide variety of configurations. For example, the subsea structure can be a flow stack, a blowout preventer, a manifold, a PLET, a Christmas tree, or any other subsea application that requires hydraulic or flowline connections. In particular, the subsea structure 12 is a high pressure structure that utilizes large bore hydraulic or flowline connections. Typically, these large bore hydraulic or flowline connections will be in the order of two inches or greater in diameter, i.e. bore diameter of about 2 inches or greater, maybe 4 inches or greater, maybe 6 inches or greater. However, the dimensions of such a large bore should not be construed, in any way, as limiting of the present invention.

Typically, the subsea structure 12 will be placed on the seabed. The junction plate 16 may be affixed to a flowline 14 of the subsea structure. Junction plate 16 has a flowline connector 18 therein. Junction plate 16 allows for fly-in connector assembly 22 to have its connector 24 connected thereto as will be explained later. Typically, the junction plate 16, along with the flowline connector 18, may be supported adjacent an exterior surface of the subsea structure 12.

The receiver 20 can be directly affixed to the junction plate 16. In any circumstances, the receiver 20 may be positioned at least adjacent to the junction plate 16. Receiver 20 may be positioned around the flowline connector 18. The receiver 20 may include flange plates 28, 30 such that flange plates 28, 30 may be attached to the receiver 20. Flange plates 28, 30 may be directly bolted to the subsea structure 12. The direct affixing of the receiver 20 through the use of flange plates 28 and 30 allows the structure of the receiver 20 to be directly supported by the subsea structure 12. As such, this will avoid any undesired bending moment imparted to the junction plate 16 and/or to the flowline 14 or the flowline connector 18.

The receiver 20 may include a first plate 32 and a second plate 34 arranged in generally spaced parallel relationship on opposite sides of the flowline connector 18. First plate 32 and second plate 34 may extend from the junction plate 16 in a direction substantially perpendicular to the junction plate 16. As such, these plates 32 and 34 may define a spacing inbetween. As will be described hereinafter, each of the plates 32, 34 may have a slot 52 or 54 formed at an end thereof opposite another end abutting the junction plate 16 (see FIG. 2). Slot 52 or 54 can be used for the receipt of the fly-in connector assembly 22 as will be explained later.

The fly-in connector assembly 22 has the connector 24 at about one end thereof. Said connector 24 may be a cylinder with a borehole 88 (shown in FIG. 4) and a central longitudinal axis 85 extending through the borehole 88. Connector 24 may be adapted to receive the flowline connector 18. In this way, connector 24 may be a female connector whereby the flowline connector 18 may be a male connector. Fly-in connector assembly 22 may have a conduit 26 having a flow passageway such that the flow passageway 26 communicates with borehole 88 of the connector 24.

Figure 4:
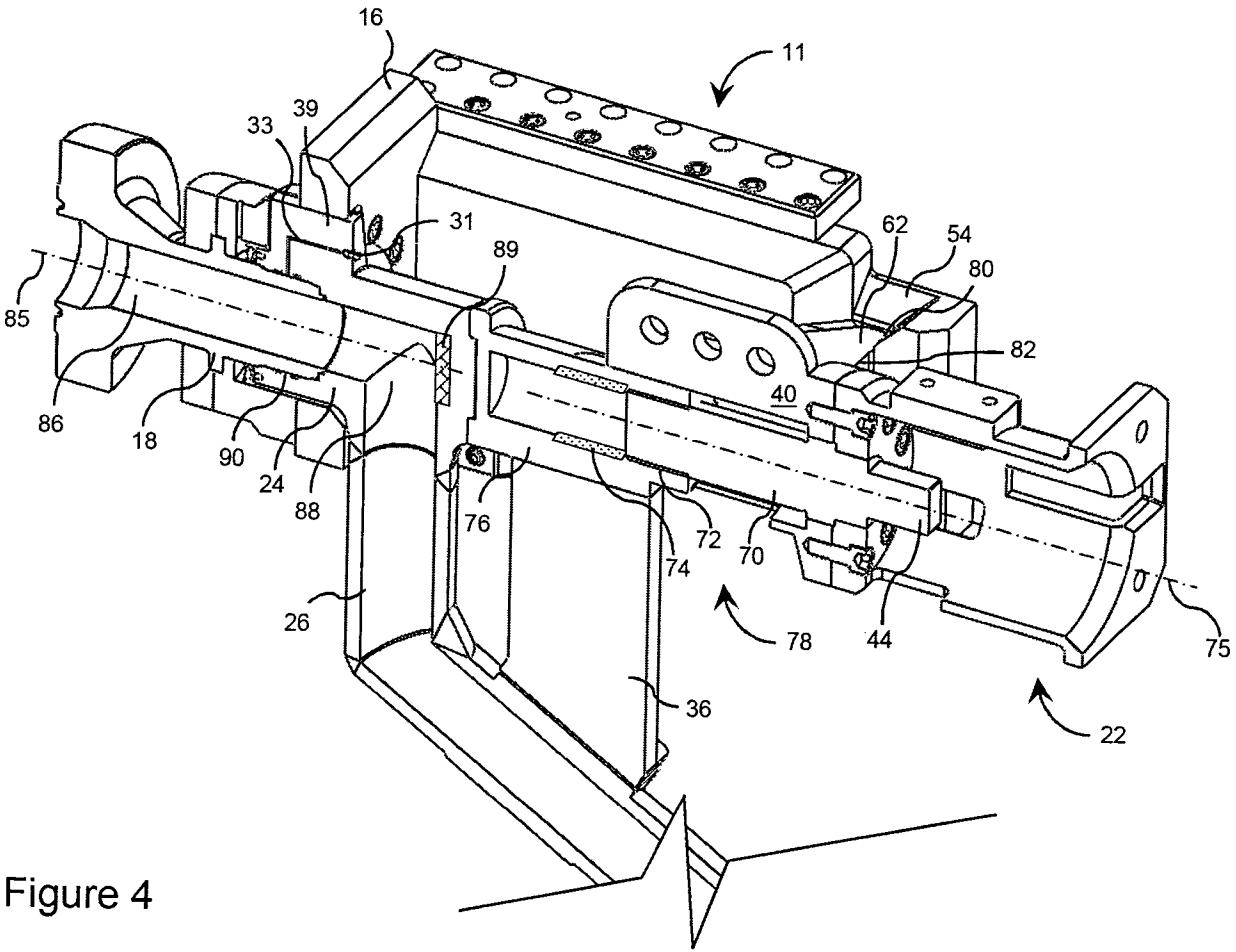
FIG. 4 is a cross-sectional view showing the installation of the fly-in connector assembly within the receiver as shown in FIG. 3.

The fly-in connector assembly 22 may have a housing 40 for receiving or housing an actuating device 78 (shown in FIG. 4). A lifting tab 38 comprising at least one pad eye 37 may extend radially outwardly from housing 40. Lifting tab 38 may be used for receiving external lifting assistance for lifting the fly-in connector assembly by attaching external connections like shackles or lifting device which are in turn connected to attachments, e.g. buoyancy modules and/or tagger lines, to facilitate connection between the fly-in connector assembly 22 and the flowline connector 18. Lifting tab 38 may have at least two pad eyes 37 spaced apart from each other. The spaced apart pad eyes 37 enable control of the yawing and pitching of the fly-in connector assembly 22 when maneuvering the fly-in connector assembly 22 to the flowline connector 18. When each pad eye 37 is connected with separate control lines, lowering one pad eye 37 with respect to the other would pitch the fly-in connector upwards or downwards respectively. When rotating one pad eye 37 about a vertical axis of another pad eye 37, which is parallel to the first and second plates 32,34 and perpendicular to longitudinal axis 75, the fly-in connector assembly 22 may yaw about the vertical axis. Lifting tab 38 may have three pad eyes 37. The fly-in connector assembly 22 may include a torque bucket 42 at an end thereof opposite the connector 24. Torque bucket 42 may be attached to the housing 40. An end effector 44 may be positioned within the torque bucket 42 and may be rotatable about the longitudinal axis 75 of the actuating device 78. The end effector 44 may be coupled to the actuating device 78 (shown in FIG. 4) for rotating it as will be explained later. The end effector 44 can be utilized by an ROV so as to carry out the necessary function of connecting the connector 24 to the flowline connector 18, to be described hereinafter. The torque bucket 42 may include a platform 41 for allowing the attachment of a ROV panel 110 (shown in FIG. 7) which may include an ROV grab handle 113. Platform 41 may be mounted to the torque bucket 42. Platform 41 may include a surface facing upward or in a direction of lifting tab extension.

Figure 2:
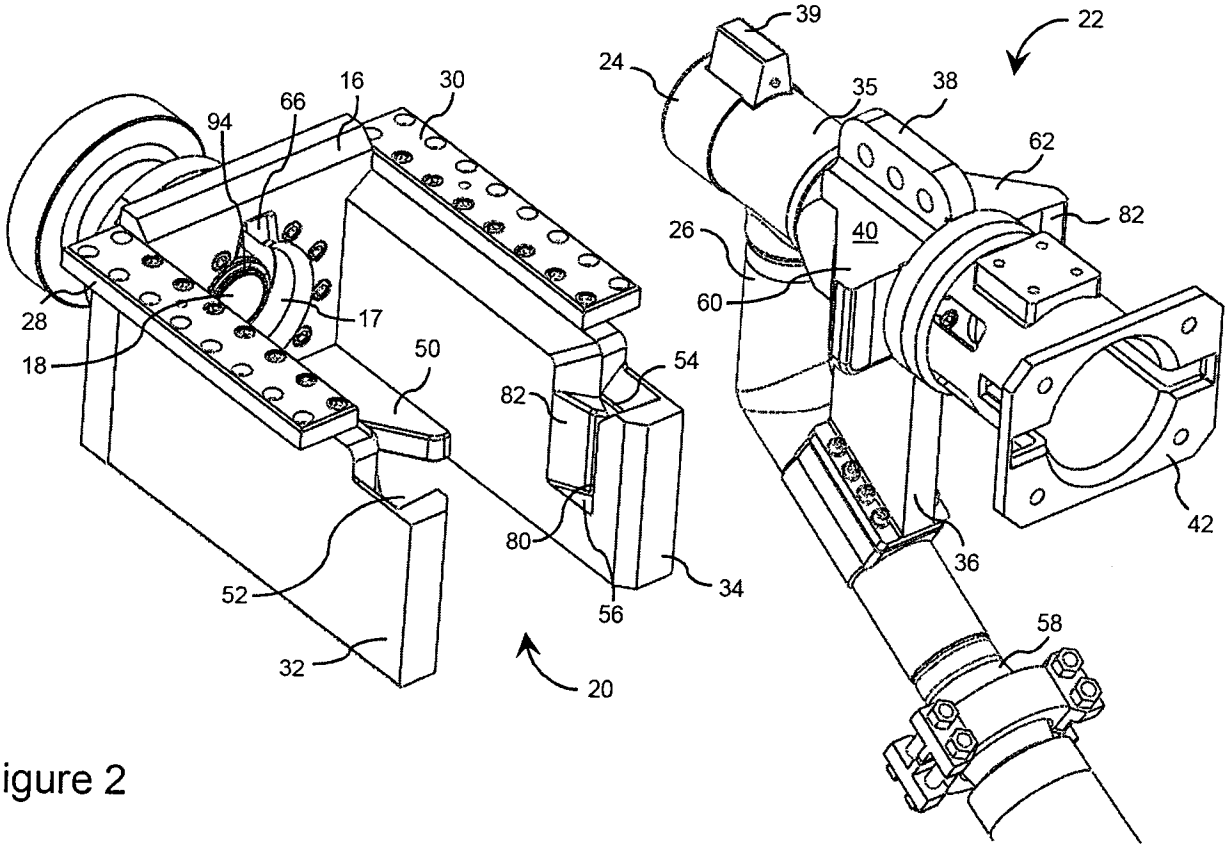
FIG. 2 is a close-up perspective view showing the positioning of the fly-in connector assembly of FIG. 1 adjacent to the junction plate and receiver.

FIG. 2 shows the positioning of the fly-in connector assembly 22 relative to the receiver 20. In FIG. 2, the receiver 20 may include the first plate 32 and the second plate 34 in generally spaced parallel relationship. Flange plates 28,30 may be rigidly affixed to one side or the top of the plates 32, 34, respectively. The flange plates 28,30 are illustrated as threadedly bolted to the plates 32 and 34 but may be attached by other known means, e.g. welding. The bolt holes associated with the flange plates 28,30 can be securely bolted to the subsea structure 12. The junction plate 16 extends between the plates 32,34 at about one end of the receiver 20. The flowline connector 18 may be positioned by the junction plate 16 so as to securely mount the flowline connector 18 thereto. Junction plate 16 may have an opening 17 and the flowline connector 18 may be attached to the junction plate 16 such that the flowline connector 18 may be disposed within the opening 17 with the opening 17 spaced radially outwardly from the flowline connector 18. Flowline connector 18 may have an end 94 and end 94 may be flush with a surface of the junction plate 16. Flowline connector 18 may be a cylinder and the opening 17 may be circular such that the ring shaped cross-section of end 94 of the flowline connector 18 and the opening may form a concentric relationship. Flowline connector 18 may be mounted to the junction plate 16 via a collar attached to the flowline connector 18 and the junction plate 16 such that the collar may be spaced from the surface of the junction plate 16. A guiding slot 66 may be provided within the junction plate 16 such that the guiding slot 66 may extend in a direction substantially parallel to the longitudinal axis of the flowline connector 18. Guiding slot 66 may be connected to the opening 17 of the junction plate 16 such that, when viewing towards the junction plate 16, the guiding slot 66 extends radially from the opening 17. Guiding slot 66, being a gap formed adjacent flowline connector 18, may be used as a spacing for connection of a test line to a test port (not shown in FIG. 2) of the fly-in connector assembly 22 or for guiding the connector 24 into the flowline connector 18 using a key 39 attached to the connector 18 in the guiding slot 66. Receiver 20 may include a pair of aligning brackets 50 (see FIG. 6A). The pair of aligning brackets 50 may be used to align the fly-in connector assembly 22 during the connecting process.

As part of receiver 20, the plate 32 has a slot 52 formed at an end thereof opposite another end of the plate 32 abutting the junction plate 16. The plate 34 has a slot 54 formed at an end thereof opposite another end of the plate 34 abutting the junction plate 16. Slot 54 has a bottom surface 56 at a lower end thereof. Each of the slots 52,54 opens at an upper end thereof so as to provide an area whereby the wing-shaped surfaces of insert member 60,62 of the fly-in connector assembly 22 can be received therein. Slots 52,54 may be substantially parallel to the junction plate 16. Slot 52,54 may be perpendicular to the direction of plates 32,34. Slot 52 may have an internal surface 80 which is substantially parallel to and facing the junction plate 16. Slot 52 may have an aligning surface 82 adjacent or connected to the internal surface 80 such that the internal surface 80 and the aligning surface 82 forms an acute angle between each other. The aligning surface 82 may form an acute angle with the longitudinal axis 85 of the connector 24. As will be shown later, the aligning surface of both slots 52,54 forms a V-shape profile for channelling the fly-in connector assembly 22 to align with the flowline connector 18 when the fly-in connector assembly 22 is pushed towards the junction plate 16. Internal surface 80 extends in a direction perpendicular to the longitudinal axis 85 of the connector 24 or parallel to the junction plate 16. Internal surface 80 and aligning surface 82 meets bottom surface 56 at one end of the surfaces.

In FIG. 2, the fly-in connector assembly 22 is illustrated as in a position slightly above the receiver 20. The connector 24 of the fly-in connector assembly 22 may be located at one end thereof. The torque bucket 42 may be positioned at an opposite end thereof and may extend from the housing 40. The conduit 26 may extend from the connector 24 outwardly from connector 24 of the fly-in connector assembly 22. Conduit 26 may extend vertically, downwardly and/or inclined from the connector 24. Conduit 26 may extend towards the torque bucket 42. Ultimately, conduit 26 has another connector 58 formed therein so as to allow the conduit 26 to be joined to another flexible or rigid flowline in a conventional manner.

The fly-in connector assembly 22 may include a first insert member 60 and second insert member 62 extending outwardly from the housing 40. Each of the insert members 60 and 62 may have a generally wing shape or triangular shape. This wing shape may have a wider end and a narrower end such that the wider end may be adjacent or join to the housing 40 and nearer to the housing 40 than the narrower end which is further away from the housing 40 than the wider end. Generally, the width of each of the insert members 60,62, or distance between the wider end and narrower end, will be less than the width of the respective slots 52,54 of the receiver 20 or the distance between the widest end and most narrow end of the slots 52,54. In other words, the width of the respective slots 52,54 may be greater than the width of the insert members 60, 62. The lifting tab 38 is illustrated as extending upwardly from the top of the housing 40, and may be formed as an integral part with the first and second insert member 60,62. As mentioned, the lifting tab 38 allows easy attachment of buoyancy elements or lifting lines for deployment/installation by usage of shackles or like. Also, a brace 36 may extend outwardly from the first portion of the actuating device 78. Brace 36 may extend downwardly or in a direction opposite to the lifting tab 38 so as to be rigidly secured to the conduit 26. Brace 36 may extend vertically and/or outwardly inclined and from first portion 70 to be rigidly secured to the conduit 26. The insert members 60,62 lifting tab 38 and housing 40 may be formed as a single piece construction or integrally formed.

Figure 3:
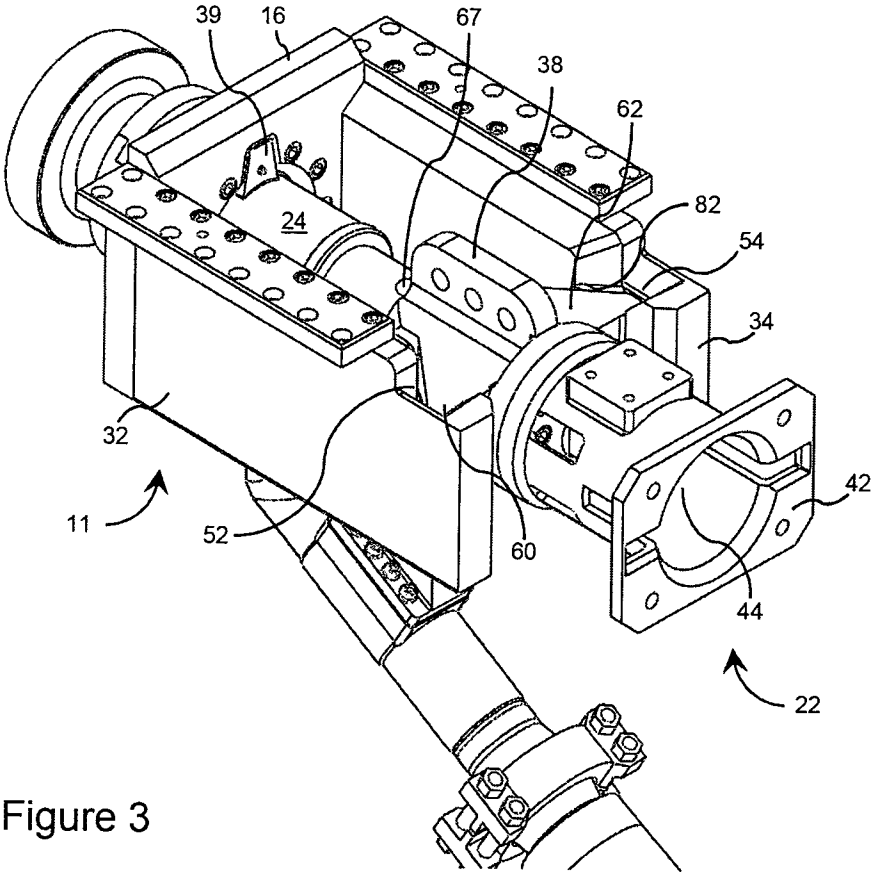
FIG. 3 is a perspective view showing the positioning of the fly-in connector assembly of FIG. 1 within the receiver.

In FIG. 3, it can be seen that the fly-in connector assembly 22 may be received within the receiver 20. In particular, the plates 32,34 may extend on opposite sides of the fly-in connector assembly 22. The connector 24 of the fly-in connector assembly 22 is illustrated in a position suitable for being connected to the flowline connector 18 (not shown in FIG. 3) at the junction plate 16.

FIG. 3 shows that the insert member 60 may be inserted into the slot 52 of the plate 32. Similarly, the insert member 62 may be inserted within the slot 54 of the plate 34. Since each of the slots 52,54 has a width that is greater than the width of the insert members 60,62, there may be a certain amount of play therebetween. In another words, the distance between the narrow ends of the insert members 60,62 is shorter than the distance between the narrow ends of the slots 52,54, such that the receiver 20 provides a tolerance for the fly-in connector assembly 22 to be received within the receiver 20. As such, as the ROV moves the fly-in connector assembly 22 into a position above the receiver 20, the insert members 60 and 62 can be aligned more easily to be inserted into the slots 52,54. Fly-in connector assembly 22 may be supported by buoyancy elements and/or lifting lines (not shown in FIG. 3) that are connected to lifting tab 38 of the fly-in connector assembly 22. In this way, the weight of the fly-in connector assembly is not passed on to the ROV thereby reducing the load demand on the ROV. The ROV, with the assistance of the buoyancy elements and/or lifting line can then lower the fly-in connector assembly 22 such that the insert members 60,62 are received, respectively, within the slots 52,54. The extra space and play that is provided allows for this connection to be easily established. Further, the tapered aligning surface of the slots 52,54 allows the fly-in connector assembly 22 to be easily aligned within the receiver 20 and therefore substantially aligned with the flowline connector 18. The torque bucket 42 and its end effector 44 (not shown in FIG. 3) are positioned outwardly of the receiver 20 which is away from the junction plate 16. Ultimately, the bottom of the insert members 60 and 62 may reside against the respective bottoms 56 (not shown in FIG. 3) of the slots 52,54 so as to establish a properly aligned position between the fly-in connector assembly 22 and the flowline connector 18 of the junction plate 16.

FIG. 4 shows the installation of the fly-in connector assembly 22 within the receiver 20 such that the connector 24 of the fly-in connector assembly 22 is connected with the flowline connector 18 of the junction plate 16. Furthermore, it details the sealing verification feature on the male portion of the flowline connector. The connector 24 being a female connector may receive the male connector 18.

Fly-in connector assembly 22 may have an actuating device 78 in contact with the connector 24. Actuating device 78 may be housed within housing 40. Actuating device 78 may be coupled to connector 24. Actuating device 78 may have a longitudinal axis 75 such that the longitudinal axis 75 of the actuating device 78 may coincide with the longitudinal axis 85 of the connector 24. Actuating device 78 may have a first portion 70 and a second portion 76 movable with respect to the first portion 70. Said second portion 76 may be movable with respect to the first portion 70 in an axial direction along the longitudinal axis 75 of the actuating device 78. First portion 70 may be a static portion and housed within the housing 40 and second portion 76 may be a moving portion and extendable out of or away from housing 40. Second portion 76 may be fixed to the connector 24 as to prevent any dissimilar rotation between said second portion and said connector 24. A brace 36 may extend from the second portion 76 to the conduit 26. As such, the conduit 26 may be rigidly supported by the actuating device 78, particularly the second portion 76 of the actuating device 78. Connector 24 may be coupled to the second portion 76.

A suitable sealing relationship can be established between the flowline connector 18 and connector 24. The end effector 44 may be coupled to the first portion 70 of the actuating device 78. First portion 70 may be cylindrical and have a threaded surface 72 formed on an exterior thereof. Second portion 76 may be correspondingly cylindrical with an inner throughbore with internal threads 74 on an interior thereof. Threaded surface 72 may be engaged with the internal threads 74 of the second portion 76 of the actuating device 78. The rotation of the end effector 44 by a suitable torque tool from an ROV may cause a rotation of the first portion 70. This rotation causes the internal thread 74 to react with the external threads 72 so as to cause the second portion 76 to move axially towards the junction plate 16. As such, the connector 24 may be pushed toward the flowline connector 18 such that the female connector 24 engages with the male flowline connector 18 in a tight and fixed manner. A strong mechanical connection may be established between the connector 24 of the fly-in connector assembly 22 and the flowline connector 18.

In FIG. 4, it can be seen that the insert member 62 may reside against internal surface 80 of the slot 54. As the first portion 70 is rotated, the insert member 62 moves backward, away from the junction plate 16, so that an end surface 82 of insert member 62 may establish a surface-to-surface contact with flat surface 80 of the slot 54. As such, the end surface 82 of the insert member 62 and the bearing surface 80 of the slot 54 may be bearing surfaces bearing the axial forces generated due to the rotation of the first portion 70. A similar action will happen with respect to the insert member 60 and the slot 52.

The conduit 26 of the fly-in connector assembly 22 being connected to the borehole 88 of the connector 24 may be in fluid communication with the interior 86 of the flowline connector 18. Conduit 26 may be connected to the connector 24 in a substantially vertical and/or inclined manner forming an L-shaped junction. As such, fluid from the flowline 14 of the subsea structure 12 flowing into connector 24 may erode the blind end of connector 24 after prolong use of the fly-in connector assembly 22. To prevent such erosion, connector 24 may include an erosion pad or target 89 at the blind end of the connector 24. Erosion target 89 may be a circular disc and disposed perpendicularly to the longitudinal axis 85 of the connector 24.

A sealing interface 90 is defined between the exterior of the male flowline connector 18 and the female connector 24. Sealing interface 90 serves to prevent fluid flow between flowline connector 18 and connector 24. The sealing interface 90 may be formed between a sealing surface 91 on the interior surface of the borehole 88 of the connector 24 and the exterior surface of the flowline connector 18. Various seals can be placed in association with the sealing interface 90 so as to provide a strong sealing relationship therebetween. The nature of this sealing surface 90 is described hereinafter in FIG. 5.

Figure 5A:
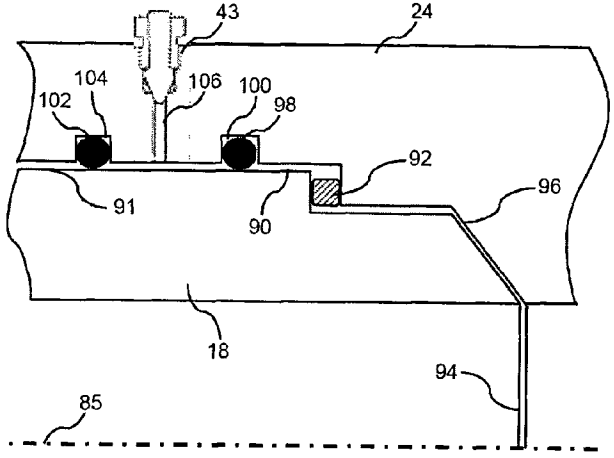
FIG. 5A is a cross-sectional close-up view showing the sealing relationship between a male portion of a flowline connector and a female portion of a connector of the fly-in connector assembly as shown in FIG. 4.

FIG. 5A illustrates the configuration of the sealing interface 90. As can be seen, the sealing interface 90 may be defined between the exterior surface of the male flowline connector 18 and sealing surface of the female connector 24. Fly-in connector assembly 22 may include a metal seal 92 within borehole 88 and may be affixed in the area between the end 94 of the male flowline connector 18 and the inner shoulder 96 of the female connector 24 when connection is made. Flowline connector 18 may have the metal seal disposed about an end thereof. As such, this metal seal 92 may provide a strong metal seal 92 between these surfaces. Typically, the metal seal 92 may deform under the strong connection forces between the flowline connector 18 and the connector 24 of the fly-in connector assembly 22. As such, a fluid (liquid and/or gas)-tight seal is formed at the interface between the male flowline connector 18 and the female connector 24.

A first elastomeric seal 98 may be received within a notch 100 formed on the sealing surface 91 of the female connector 24. Notch 100 may be spaced from the metal seal 92. Notch 100 may be along the inner surface of borehole 88. Elastomeric seal 98 may be an O-ring seal. This O-ring elastomeric seal 98 may extend around the outer diameter of the male flowline connector 18 when the connector 24 is connected to the flowline connector 18. As such, the elastomeric seal 98 may provide a secondary fluid-tight seal at the sealing interface 90. A second elastomeric seal 102 may be received within another notch 104 formed on the sealing surface 90 of the female connector 24. Said notch 104 may be spaced from the notch 100. This second elastomeric seal 102 may extend around the outer surface of the male flowline connector 18 when connection is made. The elastomeric seal 102 may correspondingly be spaced from the first elastomeric seal 98. The second elastomeric seal 102 may provide a tertiary seal as to prevent the release of any hydraulic/production/injection fluids/gases through the sealing surface 90. A hole 106 may be formed through the wall of the female connector 24. Hole 106 opens to the sealing interface 90 and may be positioned between the first elastomeric seal 98 and the second elastomeric seal 102 or between notch 100 and notch 104. Hole 106 can allow well fluids to escape therethrough if the pressure of the well fluids is beyond the ability of the seals 92 and 98 to withstand. These fluids can be diverted outwardly of the hole 106. Hole 106 may also be used as a test hole to allow verification of the seal integrity post installation make up as shown in FIG. 4 or after connection of the connector 24 and the flowline connector 18.

Figure 5B:
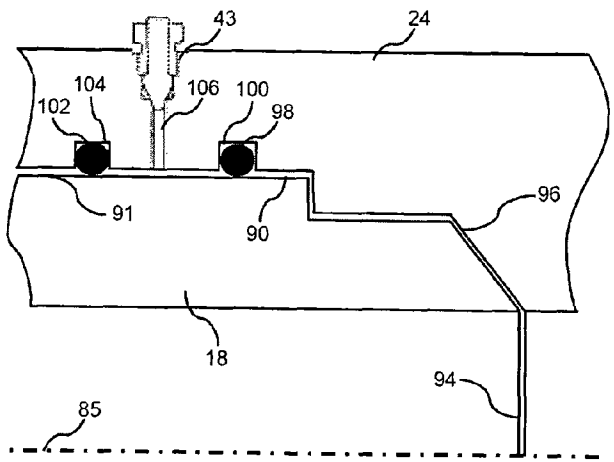
FIG. 5B is a cross-sectional close-up view showing another exemplary embodiment of the sealing relationship between a male portion of a flowline connector and a female portion of a connector of the fly-in connector assembly as shown in FIG. 5A.

In another embodiment as shown in FIG. 5B, connector 24 may have a first elastomeric seal 98 within notch 100 along the inner surface of borehole 88 of the connector 24 and a second elastomeric seal 102 within notch 104 which is spaced from notch 100 and along the inner surface of borehole 88 of the connector 24. Hole 106 in the wall of flowline connector 18 may be positioned between the first elastomeric seal 98 and second elastomeric seal 102.

Figure 5C:
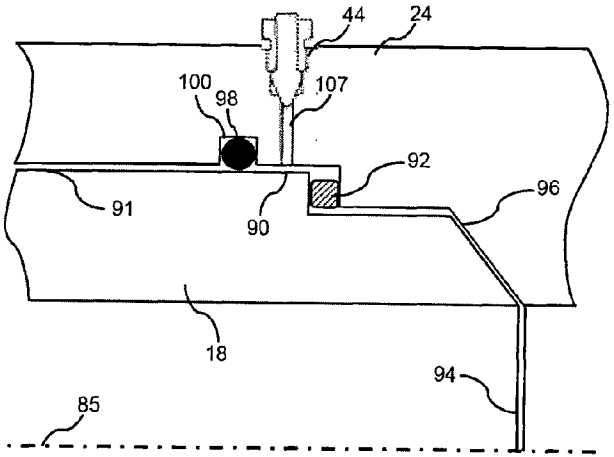
FIG. 5C is a cross-sectional close-up view showing another exemplary embodiment of the sealing relationship between a male portion of a flowline connector and a female portion of a connector of the fly-in connector assembly as shown in FIG. 5A.

In other embodiment as shown in FIG. 5C, connector 24 may have a first elastomeric seal 98 within notch 100 along the inner surface of borehole 88 of the connector 24 and a metal seal 92 spaced from the first elastomeric seal 98 and along the inner surface of borehole 88 of the connector 24. Hole 107 in the wall of flowline connector 18 may be positioned between the first elastomeric seal 98 and metal seal 92.

Figure 5D:
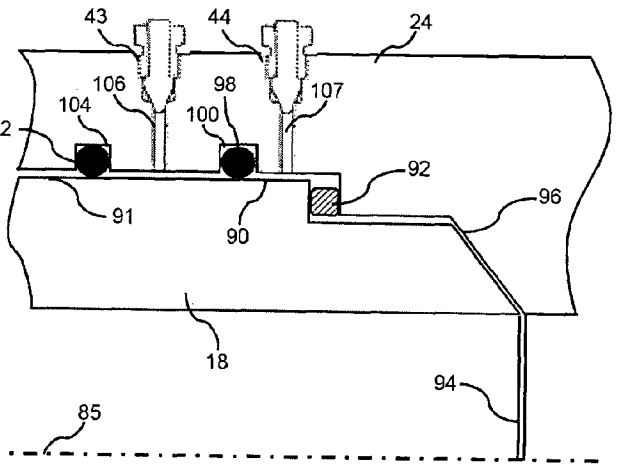
FIG. 5D is a cross-sectional close-up view showing another exemplary embodiment of the sealing relationship between a male portion of a flowline connector and a female portion of a connector of the fly-in connector assembly as shown in FIG. 5A.

In other embodiment as shown in FIG. 5D, connector 24 may have a first elastomeric seal 98 within notch 100 along the inner surface of borehole 88 of the connector 24, a second elastomeric seal 102 within notch 104 which is spaced from notch 100 and along the inner surface of borehole 88 of the connector 24 and a metal seal 92 spaced from the first elastomeric seal 98 on the other side of the first elastomeric seal 98 opposite of the second elastomeric seal 102 and along the inner surface of borehole 88 of the connector 24. In other words, the first elastomeric seal 92 may be between the second elastomeric seal 102 and metal seal 92. Holes 106,107 in the wall of flowline connector 18 may be positioned between the first elastomeric seal 98 and metal seal 92 and between first elastomeric seal 98 and second elastomeric seal 102 respectively. As shown, it is possible for various arrangements of the holes and seals to be designed and the design is not restricted to the embodiments as shown as it would be understood by the skilled person.

Hole 106 may be a test port 43 or the test port 43 (e.g. autoclave) may be disposed within hole 106 for enabling pressure testing between the seals, i.e. seal verification test. In the position of the hole 106, a key 39 may extend radially outwardly from the connector 24 (see FIG. 4). Key 39 may include a channel 33 therein whereby one end of the channel 33 may be connected to the hole 106 thereby establishing fluid communication between the hole 106 and channel 33 (see FIG. 4). The other end of the channel 33 may be exposed on a surface of the key 39 thereby forming an orifice 31 on the key 39. The surface of the key 39 with the orifice 31 may face away from the end 94 of the connector 24. As shown in FIG. 4, the channel 33 may be L-shaped for it to extend between the hole 106 and the orifice 31. As can be seen in FIG. 2, key 39 may be slotted into guiding slot 66 when the connector 24 extends into an opening 17 thereby guiding the connector 24 to connect with the flowline connector 18.

Figure 6:
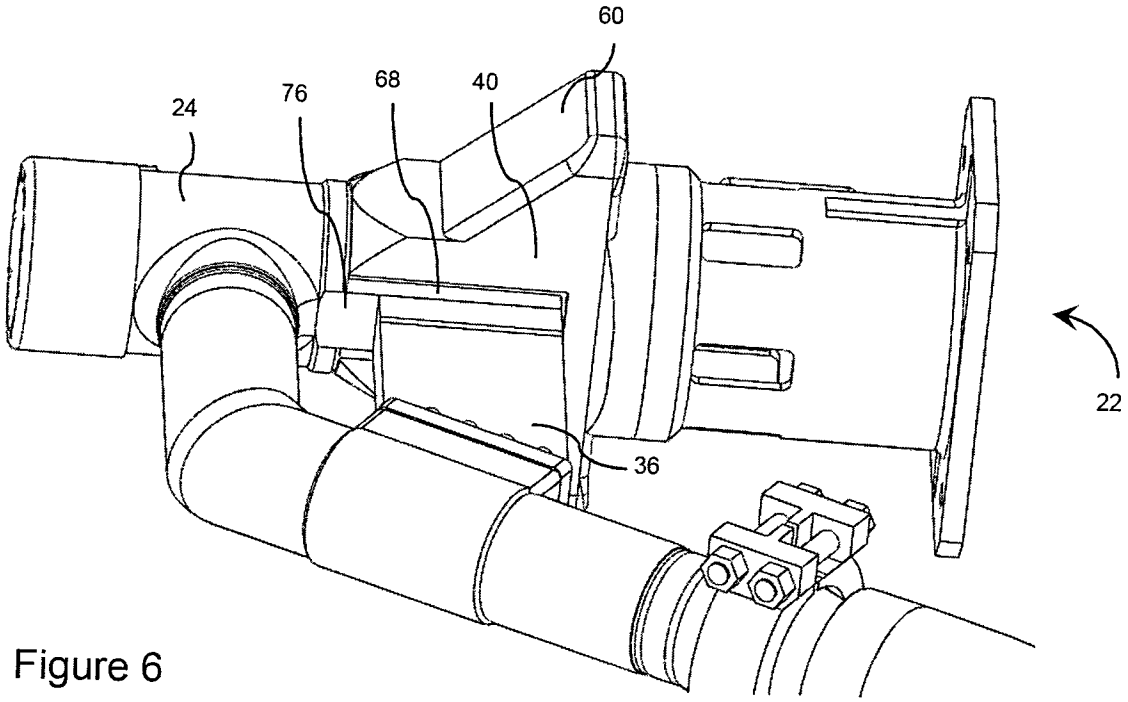
FIG. 6 is a perspective view showing the underside of the subsea flowline connection assembly as shown in FIG. 3.
Figure 6B:
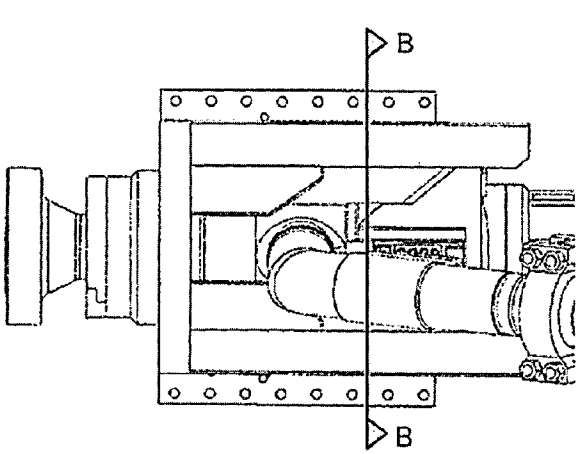
FIG. 6B is a bottom view showing another misalignment of the subsea flowline connection assembly as shown in FIG. 6.
Figure 6D:
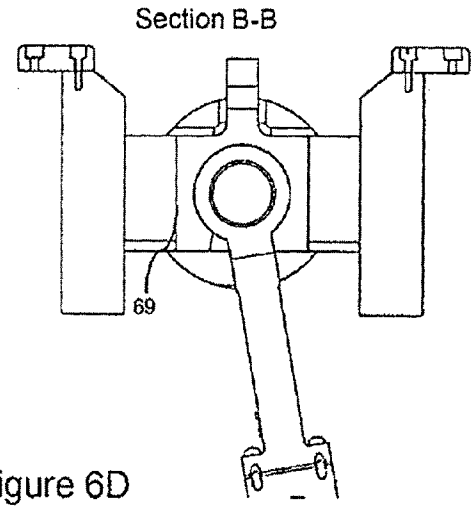
FIG. 6D is a cross-sectional view of the subsea flowline connection assembly of FIG. 6B across line B-B.

FIG. 6 shows the fly-in connector assembly 22 having a bracing receiving slot 68 positioned between the insert members 60,62 for receiving the brace 36 when the second portion 76 is in a retracted position. Insert members 60,62 and bracing receiving slot 68 may be formed as a single piece construction as part of housing 40 and bracing receiving slot 68 may be positioned at a portion between the insert members 60,62. Bracing receiving slot 68 may extend in a direction parallel to the longitudinal axis 85 of the connector 24. When in the retracted position, the brace 36 may be resided within the bracing receiving slot 68 as shown in FIG. 6. Bracing receiving slot 68 may be wider than the width of the brace 36 thereby a gap 69 may be formed between the bracing receiving slot 68 and the brace 36 on both sides of the brace 36, as shown in FIG. 6A to 6D. FIG. 6A to 6D shows an installation/make up sequence drawing showing the acceptable potential flowline misalignment of about ±10 degrees during installation and alignment of the fly-in connector assembly. The gaps 69 allow movement of the brace 36 within the bracing receiving slot 68. With reference to the second portion 76 of the actuating device 78 which may be rotatable about the longitudinal axis 75 of the first portion 70 of the actuating device 78, the brace 36 which is rigidly attached to the second portion 76 may be rotatable about the first portion 70. As shown in FIGS. 6C and 6D, the brace 36 may be restrained within the bracing receiving slot 68 to rotate about an angle of about ±10 degrees from the neutral position of the brace 36, which is when the brace 36 is centralised about the centre of the fly-in connector assembly 22.

Figure 6A:
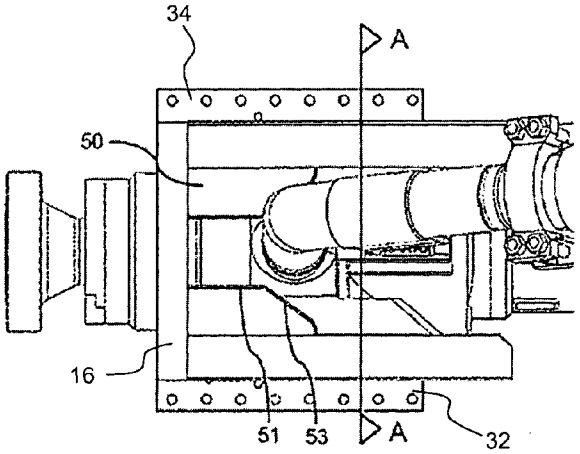
FIG. 6A is a bottom view showing the misalignment of the subsea flowline connection assembly as shown in FIG. 6.
Figure 6C:
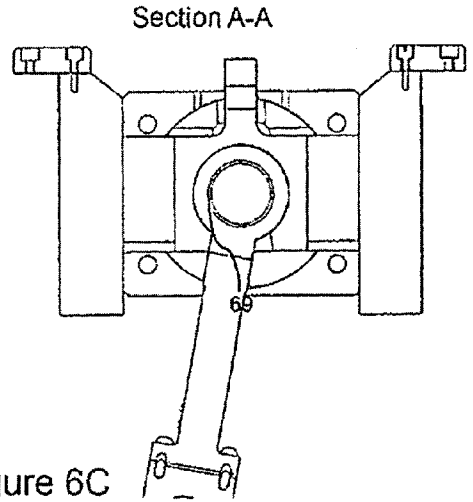
FIG. 6C is a cross-sectional view of the subsea flowline connection assembly of FIG. 6A across line A-A.

As shown in FIG. 6A, one of the pair of aligning brackets 50 may be affixed to the plate 34 and to the junction plate 16 and the other of the pair of aligning brackets 50 may be affixed to plate 32 and junction plate 16 so as to provide structural support thereto. Each of the aligning brackets 50 may have a guiding surface 51 substantially perpendicular to the junction plate 16 for aligning the fly-in connector assembly 22 and a tapered surface 53 forming an angle with the alignment surface 51 and adjacent the guiding surface 53 for guiding the connector 24 when the connector 24 extends towards the flowline connector 18. Alignment surfaces 51 may form a V-shape pointing towards the junction plate 16.

In FIG. 6, the second portion 76 of the actuating device 78 (not shown in FIG. 6) may be connected to bracing 36. The possibility of the brace 36 being able to rotate with a range of about ±10 degrees allows connection of fly-in connector assembly 22 to be more forgiving. As known to a skilled person, under the harsh subsea environment and weight of the fly-in connector assembly 22 and flowline, manoeuvring the fly-in connector assembly 22 to connect with the flowline connector 18 is substantially difficult. With a tolerance of misalignment of ±10 degrees, it is more forgiving for the ROV or diver to manoeuvre the fly-in connector assembly 22 to connect with the alignment receiving structure 20 of flowline connector assembly 11. During the process of connecting the fly-in connector assembly 22 to the flowline connector 18, the conduit 26 may be aligned by aligning brackets 50. Once the connection is fully made up, a visual indicator 67 (see FIG. 3) can be shown between housing 40 and connector 24 and may be captured by the ROV thereby verifying physically and visually the full make up of the connection.

When a strong mechanical connection is established between the connector 24 and the flowline connector 18, the strong hydraulic forces passing through the interior 86 of the flowline connector 18 and through the borehole 88 of the connector 24 will be resisted by the mechanical connection between the threaded surfaces 72 and 74 of the actuating device 78. The bearing surfaces 82 of the insert member 62 against the flat surface 80 of the slot 54 provide a secondary bearing surface for the hydraulic connection. As such, the hydraulic forces are effectively resisted by the strong mechanical connections between these surfaces.

Figure 7:
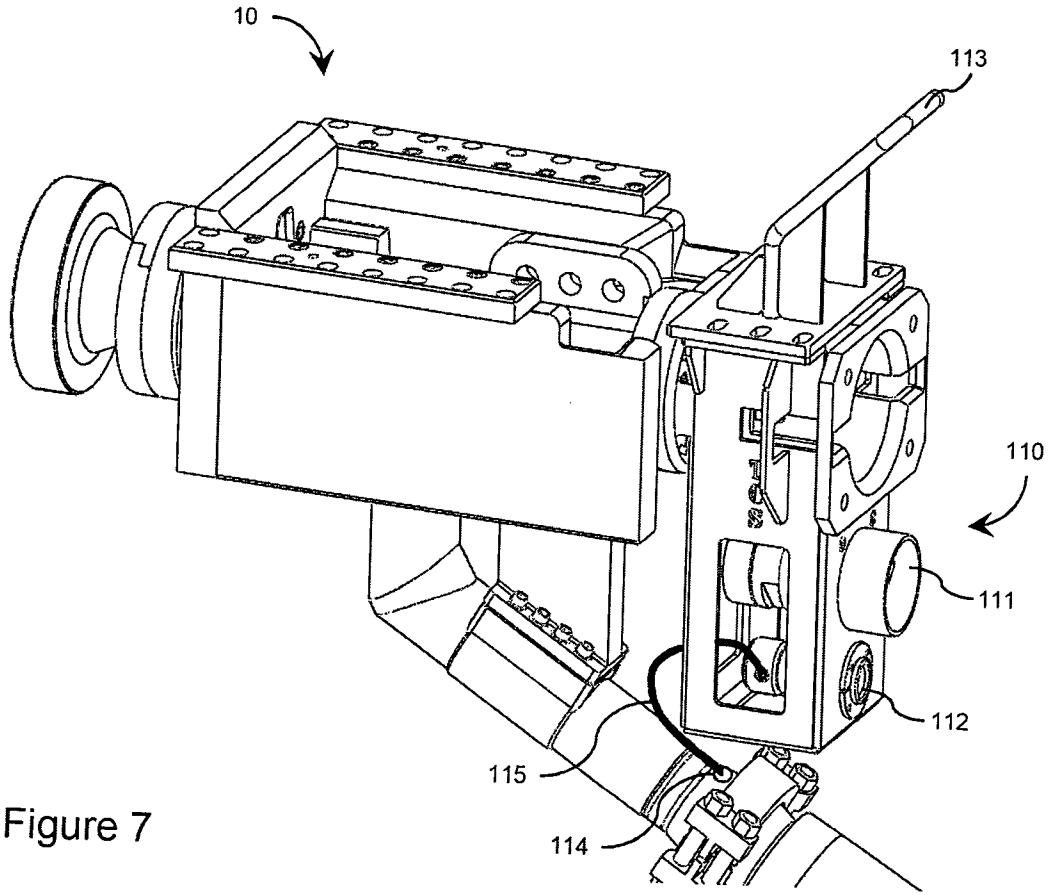
FIG. 7 shows a rear perspective view of the subsea flowline connection assembly as shown in FIG. 3 having incorporation of an ROV intervention panel as part of the female portion of the connector fly-in connector assembly.

As mentioned earlier and as shown in FIG. 7, an ROV intervention panel 110 may be attached to the platform 41 (shown in FIG. 1) by attaching means, e.g. bolt. The ROV intervention panel 110 allows data-acquisition through sensors or direct intervention through fluid communication (injection or flow) via hot stab arrangement 112. ROV panel 110 may include a ROV grab handle 113 for the ROV to hold and manoeuvre the fly-in connector assembly 22 as a guidance and installation aid. ROV panel 110 may include an isolation valve 111 and/or a hot stab 112 and a tubing or hose 115 for connecting the isolation valve 111 and/or hot stab 112 to a bore access 114 which allows flow injection or direct flow bore data acquisition through suitable flow or pressure/temperature sensors. The bore access point 114 as shown in FIG. 7 is only indicative and can be located at any suitable position on connector 24 and conduit 26 and flanges attached thereon. The tubing/hose 115 can also be connected to test port to allow seal verification testing.

In use, the fly-in connector assembly 22 can be lowered by winch and line connected to lifting tab 38 through, for example, means of attached shackle or like, to the seabed adjacent to the subsea structure 12. An ROV can grasp the fly-in connector assembly 22 by ROV grab handle 113, so as to move the fly-in connector assembly 22 to a position, such as illustrated in FIG. 1, in proximity to the receiver 20. Once the insert members 60,62 are aligned with the slots 52,54, the ROV would lower the fly-in connector assembly 22 into the receiver 20. Once lowered and parked into position wherein the insert members 60,62 sit within the slots 52,54, the torque tool of the ROV can then be applied to the end effector 44 within the torque bucket 42 so as to properly attach the fly-in connector assembly 22 to the junction plate 16 and the flowline connector 18.

Figure 8:
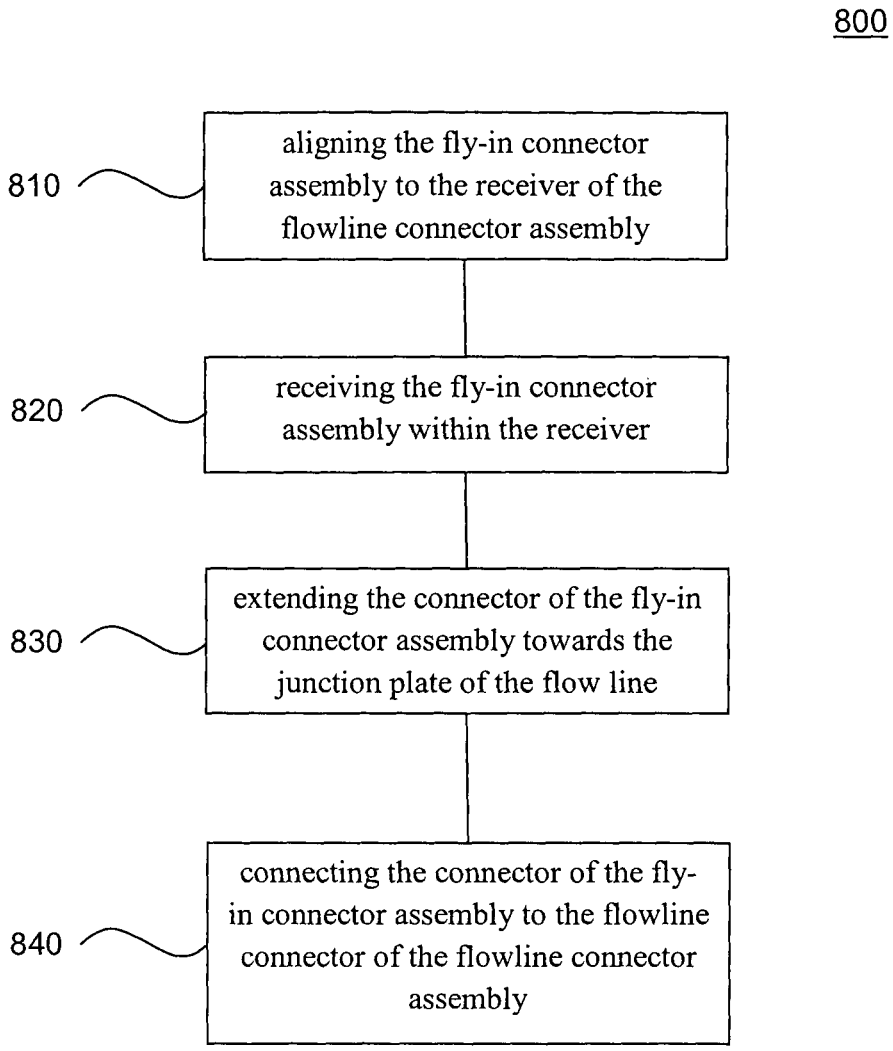
FIG. 8 shows an exemplary method for operating the subsea flowline connection assembly of FIG. 1.

A method 800 of connecting a fly-in connector assembly 22 to a flowline connector assembly 11 of the subsea structure flowline connector assembly 10 is shown in FIG. 8. In Step 810, fly-in connector assembly 22 is aligned to the receiver 20 of the flowline connector assembly 11. In Step 820, fly-in connector assembly 22 is received within the receiver 20. In Step 830, the connector 24 of the fly-in connector assembly 22 is extended towards the junction plate 18 of the flow line assembly 11. In Step 840, the connector 24 of the fly-in connector assembly 22 is connected to the flowline connector 18 of the flowline connector assembly.

Fly-in connector assembly may be received into the receiver in a direction parallel to the junction plate when the insert members 60,62 of the fly-in connector assembly is inserted into slots 52,54 of the receiver 20.

Connector 24 may be extended towards the junction plate 16 in a direction substantially perpendicular to the junction plate 16 when the actuating device 78 is being actuated by an ROV turning the end effector 44.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A subsea structure flowline connector assembly for a subsea structure comprising:

a flowline connector assembly adapted to be mountable to the subsea structure, the flowline connector assembly having:

a junction plate having a flowline connector therein; and a receiver positioned adjacent to said junction plate, said receiver having an interior exposed to said flowline connector of said junction plate, and a fly-in connector assembly adapted to be connectable to the flowline connector, said fly-in connector assembly having:

a connector thereon, said connector of said fly-in connector assembly adapted to engage said flowline connector of said junction plate to establish fluid communication, said fly-in connector assembly having a conduit in communication with said connector of said fly-in connector assembly, said conduit adapted to connect to a flowline;

an actuating device coupled to the connector for actuating the connector to engage the flowline connector; and a brace extending from the actuating device to the conduit for bracing the conduit to the actuating device, wherein the actuating device comprises a first portion and a second portion, the second portion being coupled to the connector and movable in an axial direction with respect to the first portion for actuating the connector to engage the flowline connector, and wherein the brace extends from the second portion of the actuating device to the conduit.

2. The assembly of claim 1, wherein said flowline connector is a male fixed connector, said connector of said fly-in connector assembly is a female free connector, wherein the connector of the fly-in connector assembly, when connected to flowline connector, encircles the flowline connector to form a liquid/gas tight sealing relationship to establish fluid communication.

3. The assembly of claim 1, wherein the first portion has a threaded cylindrical outer surface and the second portion has a threaded cylindrical inner surface, and the second portion is movable with respect to the first portion in threaded relation.

4. The assembly of claim 3, wherein said actuating device comprises an end effector coupled to said first portion of said actuating device, said end effector suitable for allowing an ROV to rotate said end effector and in turn rotates said first portion of the actuating device so as to move the second portion and said connector of said fly-in connector assembly toward said flowline connector.

5. The assembly of claim 1, wherein said receiver comprising a first plate and a second plate in spaced relation to said first plate, each of said first and second plates having an end adjacent to said junction plate.

6. The assembly of claim 5, wherein each of said first and second plates is directly affixed to said junction plate which in turn is directly affixed to said subsea structure.

7. The assembly of claim 1, wherein said junction plate having a guiding slot formed therein adjacent said flowline connector for guiding the fly-in connector assembly.

8. A subsea structure flowline connector assembly for a subsea structure comprising:

a flowline connector assembly adapted to be mountable to the subsea structure, the flowline connector assembly having:

a junction plate having a flowline connector therein; and a receiver positioned adjacent to said junction plate, said receiver having an interior exposed to said flowline connector of said junction plate, and a fly-in connector assembly adapted to be connectable to the flowline connector, said fly-in connector assembly having:

a connector thereon, said connector of said fly-in connector assembly adapted to engage said flowline connector of said junction plate to establish fluid communication, said fly-in connector assembly having a conduit in communication with said connector of said fly-in connector assembly, said conduit adapted to connect to a flowline;

an actuating device coupled to the connector for actuating the connector to engage the flowline connector; and a brace extending from the actuating device to the conduit for bracing the conduit to the actuating device, wherein said connector comprises a metal seal disposed at about an end thereof and a first elastomeric seal disposed within an inner borehole surface of the connector, said first elastomeric seal spaced from the metal seal, and a first hole extends through a wall of said connector and disposed between the metal seal and the first elastomeric seal, wherein when the connector is connected to the flowline connector, a sealing interface is formed by the metal seal and the first elastomeric seal between the connector and the flowline connector for providing a fluid tight connection between the connector and flowline connector.

9. The assembly of claim 8, further comprises a second elastomeric seal disposed within the inner borehole surface of the connector in spaced relationship to said first elastomeric seal and away from the metal seal, and a second hole extending through the wall of said connector, said second hole disposed between said first elastomeric seal and said second elastomeric seal.

10. The assembly of claim 8, wherein the fly-in connector assembly further comprises a key extending radially outwardly from the connector, said key comprising at least one channel in fluid communication with one or more holes, wherein one end of each channel forms an orifice on the key and the other end connected to the one or more holes.

11. A subsea structure flowline connector assembly for a subsea structure comprising:

a flowline connector assembly adapted to be mountable to the subsea structure, the flowline connector assembly having:

a junction plate having a flowline connector therein; and a receiver positioned adjacent to said junction plate, said receiver having an interior exposed to said flowline connector of said junction plate, and a fly-in connector assembly adapted to be connectable to the flowline connector, said fly-in connector assembly having:

a connector thereon, said connector of said fly-in connector assembly adapted to engage said flowline connector of said junction plate to establish fluid communication, said fly-in connector assembly having a conduit in communication with said connector of said fly-in connector assembly, said conduit adapted to connect to a flowline;

an actuating device coupled to the connector for actuating the connector to engage the flowline connector; and a brace extending from the actuating device to the conduit for bracing the conduit to the actuating device, wherein the connector comprises a first elastomeric seal disposed within an inner borehole surface of the connector, a second elastomeric seal disposed within the inner borehole surface of the connector in spaced relationship to said first elastomeric seal and a hole extending through the wall of said connector, said hole disposed between said first elastomeric seal and said second elastomeric seal, wherein when the connector is connected to the flowline connector, a sealing interface is formed by the first elastomeric seal and the second elastomeric seal between the connector and the flowline connector for providing a fluid tight connection between the connector and flowline connector.

12. A subsea structure flowline connector assembly for a subsea structure comprising:

a flowline connector assembly adapted to be mountable to the subsea structure, the flowline connector assembly having:

a junction plate having a flowline connector therein; and a receiver positioned adjacent to said junction plate, said receiver having an interior exposed to said flowline connector of said junction plate, and a fly-in connector assembly adapted to be connectable to the flowline connector, said fly-in connector assembly having:

a connector thereon, said connector of said fly-in connector assembly adapted to engage said flowline connector of said junction plate to establish fluid communication, said fly-in connector assembly having a conduit in communication with said connector of said fly-in connector assembly, said conduit adapted to connect to a flowline;

an actuating device coupled to the connector for actuating the connector to engage the flowline connector; and a brace extending from the actuating device to the conduit for bracing the conduit to the actuating device, wherein said receiver comprising a first plate and a second plate in spaced relation to said first plate, each of said first and second plates having an end adjacent to said junction plate, and wherein each of said first and second plates comprises a slot formed adjacent an end opposite the end abutting or adjacent the junction plate, said slot comprises a bearing surface thereon substantially parallel to the junction plate and a bottom surface substantially perpendicular to the bearing surface.

13. The assembly of claim 12, wherein said fly-in connector assembly comprises a housing adapted to receive the actuating device, a first insert member and second insert member formed on opposite sides of the housing, each of said first and second insert members having a wing shaped tapering profile such that each of said first and second insert members has a wider end joined to said housing and a narrower end opposite the wider end and away from said housing, said first insert member being receivable in said slot of said first plate and said second insert member being receivable in said slot of said second plate, wherein, each of said first and second inserts, each insert comprises a flat surface at an end thereof for bearing against the bearing surface of the respective slots and a bottom surface for abutting said bottom surface of the respective slots.

14. The assembly of claim 13, wherein the width of said slots is greater than the width of the corresponding first or second insert member.

15. The assembly of claim 13, wherein said fly-in connector assembly having a lifting tab having at least one pad eye for receiving external lifting assistance for lifting the fly-in connector assembly, said lifting tab extending radially and outwardly from the housing.

16. The assembly of claim 13, further comprising a bracing receiving slot arranged on said housing between the first insert member and second insert member wherein said brace extends through the slot and the slot is wider than the brace thus allowing the brace to be rotatable about a longitudinal axis of the actuating device within the bracing receiving slot.

17. The assembly of claim 13, further comprising a torque bucket attached to the housing and a platform mounted on the torque bucket for receiving ROV attachments.

18. An apparatus comprising:

a subsea structure having a flowline therein; and a subsea structure flowline connector assembly for the subsea structure comprising:

a flowline connector assembly adapted to be mountable to the subsea structure, the flowline connector assembly having:

a junction plate having a flowline connector therein; and a receiver positioned adjacent to said junction plate, said receiver having an interior exposed to said flowline connector of said junction plate, and a fly-in connector assembly adapted to be connectable to the flowline connector, said fly-in connector assembly having:

a connector thereon, said connector of said fly-in connector assembly adapted to engage said flowline connector of said junction plate to establish fluid communication, said fly-in connector assembly having a conduit in communication with said connector of said fly-in connector assembly, said conduit adapted to connect to a flowline;

an actuating device coupled to the connector for actuating the connector to engage the flowline connector; and a brace extending from the actuating device to the conduit for bracing the conduit to the actuating device, wherein the actuating device comprises a first portion and a second portion, the second portion being coupled to the connector and movable in an axial direction with respect to the first portion for actuating the connector to engage the flowline connector, and wherein the brace extends from the second portion of the actuating device to the conduit.

19. A method of connecting a fly-in connector assembly to a flowline connector assembly of a subsea structure flowline connector assembly for a subsea structure, the subsea structure flowline connector assembly comprising:

a flowline connector assembly adapted to be mountable to the subsea structure, the flowline connector assembly having:

a junction plate having a flowline connector therein; and a receiver positioned adjacent to said junction plate, said receiver having an interior exposed to said flowline connector of said junction plate, and the fly-in connector assembly adapted to be connectable to the flowline connector, said fly-in connector assembly having:

a connector thereon, said connector of said fly-in connector assembly adapted to engage said flowline connector of said junction plate to establish fluid communication, said fly-in connector assembly having a conduit in communication with said connector of said fly-in connector assembly, said conduit adapted to connect to a flowline;

an actuating device coupled to the connector for actuating the connector to engage the flowline connector; and a brace extending from the actuating device to the conduit for bracing the conduit to the actuating device, wherein the actuating device comprises a first portion and a second portion, the second portion being coupled to the connector and movable in an axial direction with respect to the first portion for actuating the connector to engage the flowline connector, and wherein the brace extends from the second portion of the actuating device to the conduit;

said method comprising:

aligning the fly-in connector assembly to the receiver of the flowline connector assembly;

receiving the fly-in connector assembly within the receiver;

extending the connector of the fly-in connector assembly towards the junction plate of the flow line assembly; and connecting the connector of the fly-in connector assembly to the flowline connector of the flowline connector assembly.

20. The method as claimed in claim 19, wherein the connector is extended towards the junction plate in a direction substantially perpendicular to the junction plate.

21. A method of connecting a fly-in connector assembly to a flowline connector assembly of a subsea structure flowline connector assembly for a subsea structure, the subsea structure flowline connector assembly comprising:

a flowline connector assembly adapted to be mountable to the subsea structure, the flowline connector assembly having a junction plate having a flowline connector therein; and a receiver positioned adjacent to said junction plate, said receiver having an interior exposed to said flowline connector of said junction plate, and the fly-in connector assembly adapted to be connectable to the flowline connector, said fly-in connector assembly having a connector thereon, said connector of said fly-in connector assembly adapted to engage said flowline connector of said junction plate to establish fluid communication, said fly-in connector assembly having a conduit in communication with said connector of said fly-in connector assembly, said conduit adapted to connect to a flowline;

an actuating device coupled to the connector for actuating the connector to engage the flowline connector; and a brace extending from the actuating device to the conduit for bracing the conduit to the actuating device, said method comprising:

aligning the fly-in connector assembly to the receiver of the flowline connector assembly;

receiving the fly-in connector assembly within the receiver;

extending the connector of the fly-in connector assembly towards the junction plate of the flow line assembly; and connecting the connector of the fly-in connector assembly to the flowline connector of the flowline connector assembly, wherein the fly-in connector assembly is received into the receiver in a direction parallel to the junction plate.

* * * * *